US011560291B2

(12) United States Patent
Haapaniemi et al.

(10) Patent No.: US 11,560,291 B2
(45) Date of Patent: Jan. 24, 2023

(54) ELEVATOR ARRANGEMENT TO OPEN THE ROOF OF AN ELEVATOR CAR

(71) Applicant: Kone Corporation, Helsinki (FI)

(72) Inventors: Markku Haapaniemi, Helsinki (FI); Esko Aulanko, Kerava (FI); Matti Rasanen, Helsinki (FI); Ari Kattainen, Helsinki (FI); Antti Hovi, Hyvinkaa (FI)

(73) Assignee: Kone Corporation, Helsinki (FI)

( * ) Notice: Subject to any disclaimer, the term of this patent is extended or adjusted under 35 U.S.C. 154(b) by 304 days.

(21) Appl. No.: 16/220,290

(22) Filed: Dec. 14, 2018

(65) Prior Publication Data

US 2019/0119072 A1 Apr. 25, 2019

Related U.S. Application Data

(63) Continuation of application No. PCT/FI2016/050524, filed on Jul. 15, 2016.

(51) Int. Cl.

| | |
|---|---|
| ***B66B 11/02*** | (2006.01) |
| ***B66B 5/00*** | (2006.01) |
| ***B66B 1/46*** | (2006.01) |
| *B66B 1/14* | (2006.01) |

(52) U.S. Cl.

CPC ..... *B66B 11/0246* (2013.01); *B66B 1/466* (2013.01); *B66B 5/005* (2013.01); *B66B 5/0087* (2013.01); *B66B 1/14* (2013.01)

(58) Field of Classification Search

CPC ..... B66B 11/0246; B66B 1/466; B66B 5/005; B66B 5/0087; B66B 1/14

See application file for complete search history.

(56) References Cited

U.S. PATENT DOCUMENTS 6,202,800 B1 * 3/2001 Muller ..... B66B 11/0246 187/401
6,202,801 B1 * 3/2001 Muller ..... B66B 11/0246 187/269
6,419,052 B1 * 7/2002 Muller ..... B66B 11/0246 187/414

(Continued)

FOREIGN PATENT DOCUMENTS

CN 203486707 * 1/2007
EP 1174381 A1 * 1/2002 ..... B66B 11/0045

(Continued)

OTHER PUBLICATIONS

JP2007001698—Machine Translation (Year: 2007).*

(Continued)

*Primary Examiner* — Michael A Riegelman

(74) *Attorney, Agent, or Firm* — Harness, Dickey & Pierce, P.L.C.

(57) ABSTRACT

The invention relates to an elevator arrangement comprising an elevator with a control system, and an inspection or maintenance mode, which elevator further comprises an elevator car arranged to run up and down in an elevator shaft along its guide rails, and which elevator car is equipped with a roof and a car operating panel. The arrangement comprises actuating means to open the roof of the elevator car, which actuating means are operatively connected to the car operating panel of the elevator.

16 Claims, 4 Drawing Sheets

(56) References Cited

U.S. PATENT DOCUMENTS

Figure 1:
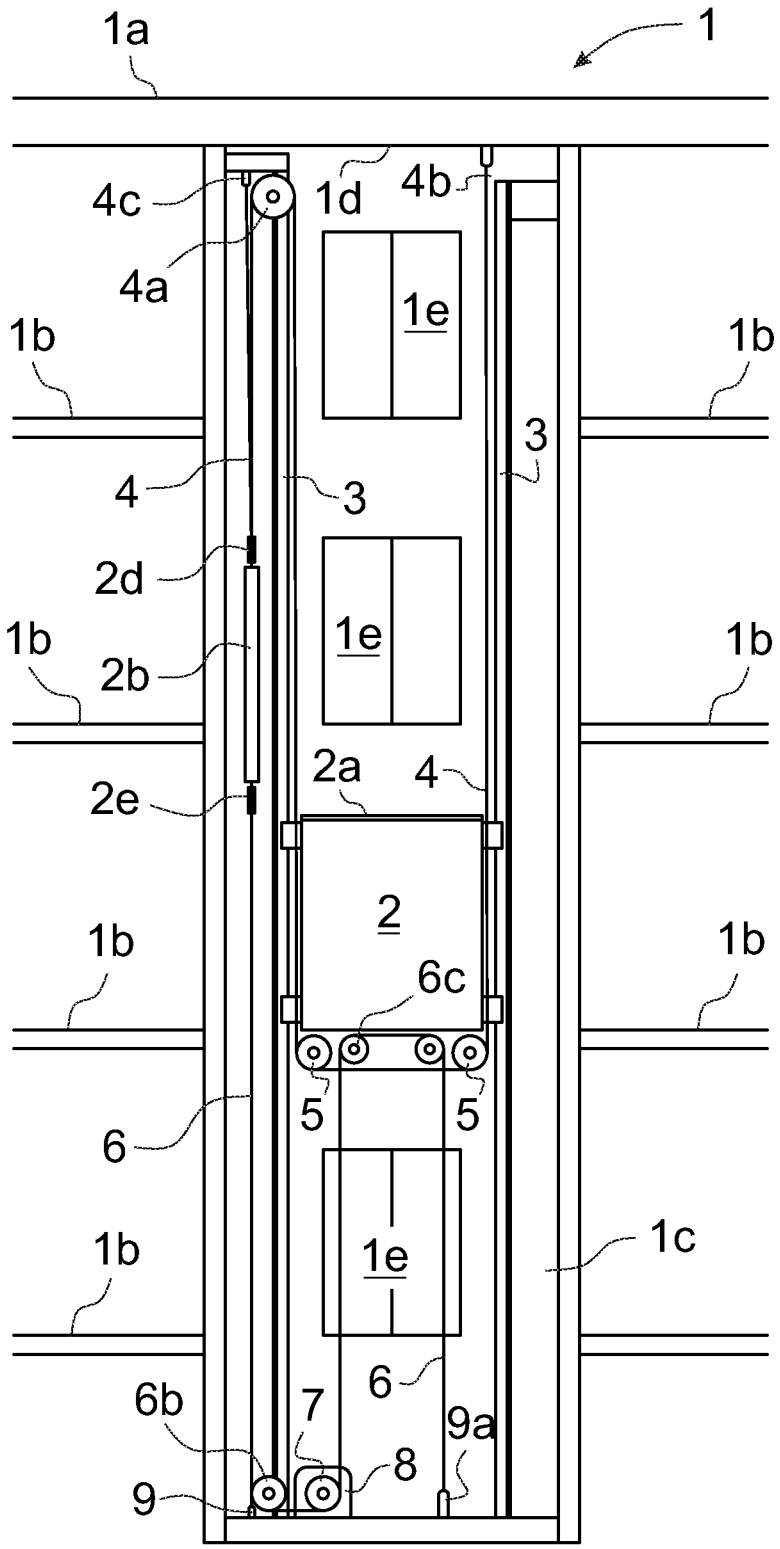

| | | | | |
|---|---|---|---|---|
| 6,691,833 | B1 * | 2/2004 | Elsener | B66B 5/288 187/266 |
| 8,602,171 | B2 * | 12/2013 | Vogl | B66B 5/005 187/314 |
| 2003/0015378 | A1 * | 1/2003 | Elsener | B66B 11/0246 187/336 |
| 2007/0056809 | A1 * | 3/2007 | Fernandes | B66B 11/0246 187/401 |
| 2007/0056810 | A1 * | 3/2007 | Fernandes | B66B 5/00 187/401 |
| 2010/0038183 | A1 * | 2/2010 | Henseler | B66B 11/0246 187/276 |
| 2010/0200339 | A1 * | 8/2010 | Henseler | B66B 5/005 187/401 |
| 2011/0155510 | A1 * | 6/2011 | Lindberg | B66B 5/005 187/314 |
| 2012/0279805 | A1 * | 11/2012 | Meyer | F03D 80/50 187/261 |
| 2018/0105395 | A1 * | 4/2018 | Cortes | B66B 1/461 |
| 2018/0282119 | A1 * | 10/2018 | Lindberg | B66B 11/0246 |
| 2019/0112158 | A1 * | 4/2019 | Haapaniemi | B66B 11/0246 |
| 2019/0119072 | A1 * | 4/2019 | Haapaniemi | B66B 11/0246 |
| 2019/0119073 | A1 * | 4/2019 | Haapaniemi | B66B 11/0246 |
| 2019/0119074 | A1 * | 4/2019 | Haapaniemi | B66B 5/005 |
| 2019/0135586 | A1 * | 5/2019 | Haapaniemi | B66B 1/28 |
| 2019/0263629 | A1 * | 8/2019 | Fernandez | B66B 11/0246 |
| 2019/0308848 | A1 * | 10/2019 | Litteral | B66F 3/22 |
| 2019/0330023 | A1 * | 10/2019 | Fauconnet | B66B 11/0206 |
| 2020/0255262 | A1 * | 8/2020 | Haapaniemi | B66B 11/0226 |

FOREIGN PATENT DOCUMENTS

| | | | | |
|---|---|---|---|---|
| EP | 1466853 | A1 * | 10/2004 | B66B 5/005 |
| EP | 1566357 | A1 | 8/2005 | |
| JP | 2007-001698 | A | 1/2007 | |
| WO | WO-2016151350 | A1 | 9/2016 | |

OTHER PUBLICATIONS

CN203486707—Machine Translation (Year: 2007).*

International Search Report (PCT/ISA/210) for PCT International Application No. PCT/FI2016/050524 which has an International Filing date of Jul. 15, 2016.

Written Opinion (PCT/ISA/237) for PCT International Application No. PCT/FI2016/050524 which has an International Filing date of Jul. 15, 2016.

* cited by examiner

ELEVATOR ARRANGEMENT TO OPEN THE ROOF OF AN ELEVATOR CAR

This application is a continuation of PCT International Application No. PCT/FI2016/050524 which has an International filing date of Jul. 15, 2016, the entire contents of which are incorporated herein by reference.

The present invention relates to an elevator arrangement to open the roof of an elevator car.

The elevator car roof is opened for enabling the elevator shaft maintenance work and also maintenance of equipment located adjacent to the elevator car top.

Typically an elevator arrangement comprises an elevator with an elevator operating system, a control system, and a maintenance mode. A typical elevator of the arrangement comprises an elevator car arranged to run up and down in an elevator shaft along its path, and is equipped with a roof and a car operating panel. The invention aims to provide improved safety in maintenance work.

The maintenance work in this connection means all the work that is done when an inspection mode or RDF mode is switched on. The RDF mode is also called as emergency electrical operation mode. Later in this connection only a term "maintenance mode" is used to mean all the other operation modes of the elevator except the normal operation mode. In the maintenance mode like this inspection, adjustment, maintenance, test and repair works are usually done for the elevator.

The invention in question relates particularly to an elevator where a headroom in the elevator shaft is low. In elevators like this usually no additional material can be placed outside the elevator car, particularly onto the roof of the elevator car.

The headroom in this context means the clearance between the roof of the elevator car and the ceiling of the elevator shaft in the situation when the elevator car is at its uppermost position. Various tasks, such as inspections, adjustment works, maintenance or repairs, later referred in a shorter way only as "maintenance work", are often performed at the upper part of the elevator shaft. In that case the safety of the persons performing the tasks mentioned above has always to be secured. If the height of the top clearance of the elevator shaft is low, in other words the headroom is low, a sufficient safety space, which prevents injuries occurring for persons working on the roof of the elevator car, cannot always be guaranteed without special procedures.

Usually the maintenance work is done on the roof of the elevator car. In that case, when working on the roof of the elevator car an unintentional movement of the elevator car must be prevented in some other way than by the regular operating brakes of the elevator. It is known in the prior art that this kind of prevention can be done by locking the elevator car and/or the counterweight into their positions on the guide rail, for instance by means of a safety gear, a latch or wedges. However, this often requires that the working persons must separately go to the elevator shaft and perform the locking. That makes safety preparation tasks awkward, laborious and time-consuming.

Another solution according to prior art for achieving an adequate safety space in the upper part of an elevator shaft is to use one or more turnable buffers that are disposed below the counterweight. The buffer is lifted upright before going onto the roof of the elevator car. The length of the buffer is such that the movement of the counterweight, and at the same time the movement of the elevator car, stops before the elevator car rises too high with respect to the ceiling of the elevator shaft. One problem, among others, in this solution is, however, that the shaft space might have been dimensioned so precisely that there is no proper space in the bottom part of the elevator shaft for a turnable buffer. Another problem is that the aforementioned buffer ensuring the top safety space is in the bottom part of the elevator shaft, i.e. right at the other end of the elevator shaft. In that case setting the buffer into the safe position takes extra time and it may also happen that for this reason the person in charge does not remember to go down to the bottom of the elevator shaft to turn them into the safe position.

In addition to the aforementioned, the safety solutions are often based on electrical supervision controls installed in the doors of the shaft, which controls must be switched to the safe position before going onto the roof of the elevator car. Turning the buffers into the safe position and activation of the electrical control circuits are often such a complex combination that, particularly e.g. with small tasks, they might be left undone owing to their complexity and for saving the time used. In addition, electrical supervision control systems are susceptible to failure.

Yet one solution according to the prior art is shown in the US patent publication No. US2010/0200339 A1. The solution according to the US publication presents an elevator safety system for elevators with a reduced upper end of the elevator shaft. In this solution the roof of the elevator car cannot be used as a working base, because the roof of the elevator car is constructed so that it does not support weight. Thus, it is not possible to be or work on the roof of the elevator car. In this case the required free safety space is formed completely inside the elevator car when the elevator car is in its uppermost position. As the roof is not designed to bear loads, in such a situation a weight on the roof may deform or even broke the roof structures. The maintenance work at the top part of the elevator shaft is done inside the elevator car. For this purpose a part of the sidewall of the car is made removable and the maintenance work is done though the opening in the sidewall when the part mentioned above has been removed from the sidewall. However, the problem in this solution is the fact that there are only limited possibilities to make inspection, repair and maintenance work because only one certain opening is used. And likewise there are limited possibilities to place elevator appliances that require regular maintenance in the elevator shaft because the opening is only at one sidewall of the car. In addition the opening makes the wall structure more expensive, more complicated and also weaker than the unbroken wall structure.

One objective of the present invention is to eliminate drawbacks of prior art technology and to achieve an elevator arrangement where the headroom at the upper part of the elevator shaft can be as low as possible, and the elevator shaft is completely inside the building so that there is no need to penetrate the roof of the building. Another objective of the present invention is to achieve a safe space for maintenance work of the elevator appliances in the elevator shaft, and make it possible to perform maintenance work from inside the elevator car. And yet another objective of the present invention is to achieve an arrangement that is operationally extremely reliable, easy and fast to use, and where all the control appliances for maintenance work are inside the elevator car. Yet another objective of the present invention is to achieve an arrangement where the opening of the roof of the elevator car is fast and easy to do and can be done inside the car, for example by using car control panel.

The elevator arrangement according to the inventive concepts is characterized by what is disclosed below The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment can also be applied in other embodiments. In addition it can be stated that at least some of the subordinate claims can, in at least some situations, be deemed to be inventive in their own right.

In order to achieve the objectives mentioned above, the present invention provides an elevator arrangement comprising an elevator with an elevator operating system, a control system, and a maintenance mode, which elevator further comprises an elevator car arranged to run up and down in an elevator shaft along its guide rails, and which elevator car is equipped with a roof and a car operating panel. An advantageous way to realize the invention is to arrange the car operating panel as control interface for the roof opening. Advantageously the arrangement comprises actuating means to open the roof of the elevator car, which actuating means are operatively connected to the car operating panel of the elevator car. The actuating means may be also used to close the roof of the elevator car.

The actuating means may also be a simple locking means to unlock the roof of the elevator car when opening the roof and to lock the roof at its uppermost position and to lock the roof at its lowermost position when the roof is again lowered down. In that case the roof is lifted to its uppermost position and lowered to its lowermost position, in a shorter way the roof is moved, by various means and mechanisms. The moving of the roof can be realized, for instance, by a spring mechanism equipped with a gas spring dampening, a screw rotated manually or with a machine, pneumatically, hydraulically or even manually just pushing the roof upwards and pulling it downwards.

One advantage of the invention is that the invention enables a safe an inexpensive way of providing an elevator that has an extremely low top clearance or headroom. The top clearance can even be minimized to the minimum, or close to the minimum, required only by the trajectory of the elevator car. Thus when the elevator car is in its uppermost possible position on its trajectory, the shaft space above the elevator car is small and the height of the elevator shaft can easily be fitted inside the building, without penetrating the roof of the building. Another advantage is that invention enables a safer way to perform maintenance work because the persons can be inside the elevator car and all the needed buttons to control the movement of the elevator car are well accessible inside the elevator car. A further advantage is also that the solution is inexpensive and simple to implement. In that case the existing car operating panel (COP) can be used for opening and closing the roof of the elevator car and there is no need to equip the elevator with separate control appliances for operating the roof of the elevator car. Yet a further advantage is that the opening and closing of the roof can be done safely when standing on the floor of the elevator car. Yet a further advantage is that the solution is very easy and quick to use, and does require neither awkward working in the elevator shaft nor preliminary procedures at the top end or bottom end of the elevator shaft. Yet a further advantage is that uplifted roof protects the working person in the elevator car from possible falling objects in the elevator shaft.

In an advantageous embodiment the roof of the elevator car is lifted to its upper position to enable a maintenance person to reach the maintenance work items outside the elevator car. After completing the maintenance work the roof is lowered to its closed position. The moving of the roof of the elevator car is performed by using buttons of the existing car operating panel of the elevator car. That makes it also possible that in many cases there is no need to open the landing door at all because all the maintenance work can be done inside the elevator car. In these cases the traditional triangle key is not needed to open the landing door, and in many cases it can be totally left away of the elevator structure. This improves safety because outside persons cannot use their own triangle keys to get an unauthorized and unsafe access to the elevator shaft.

Figure 2:
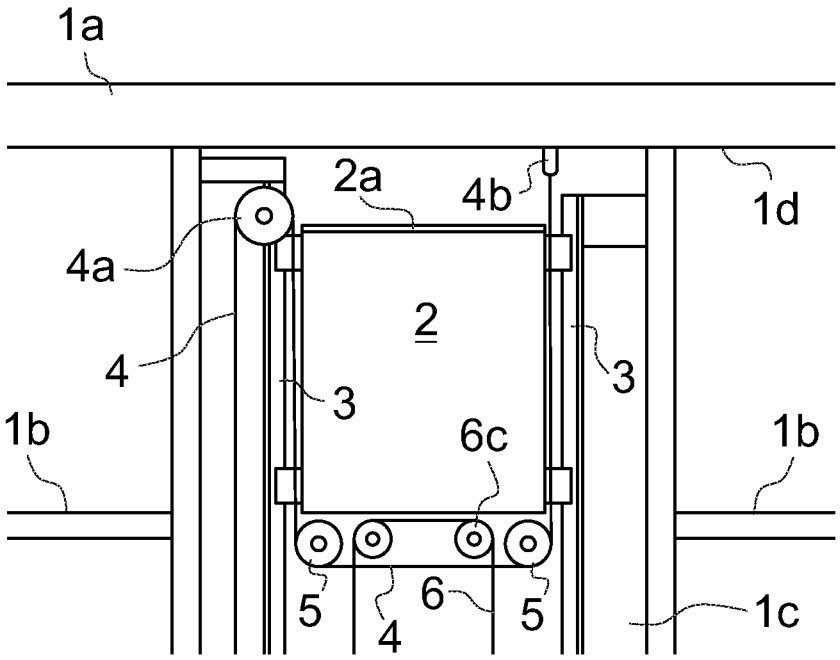
Figure 3:
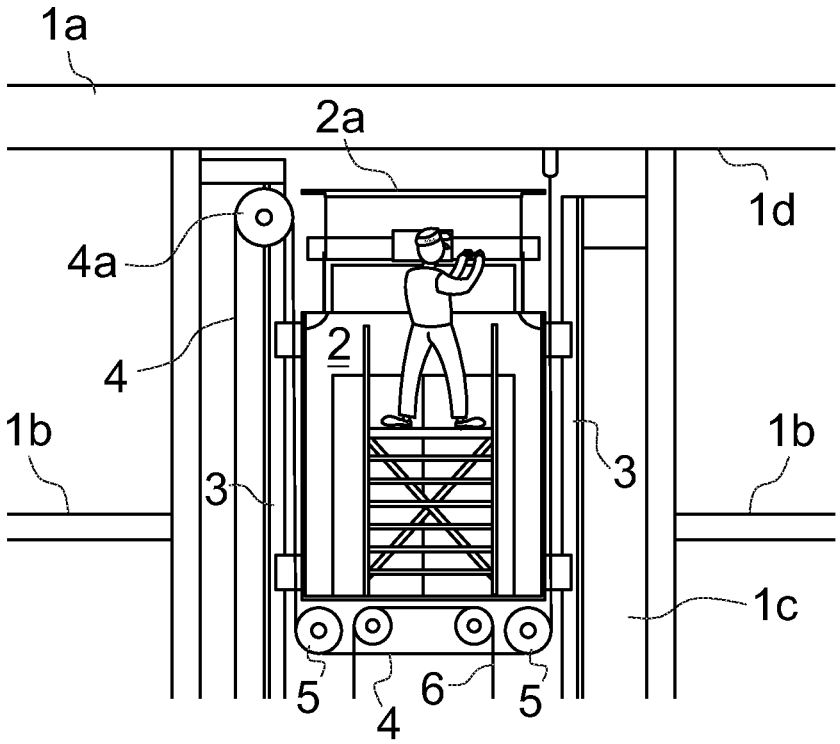
Figure 4:
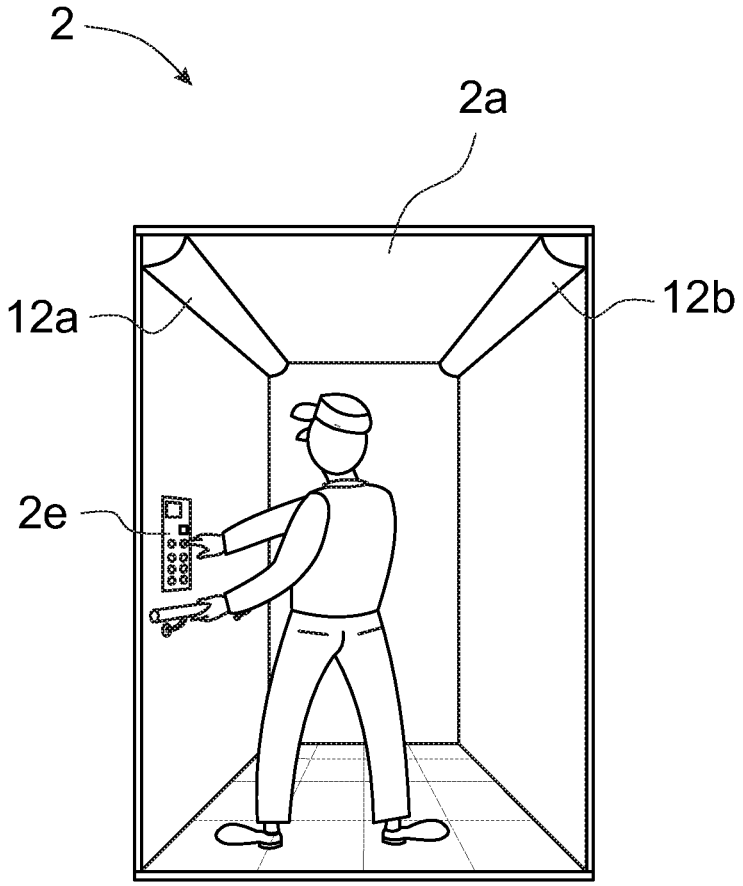
Figure 5:
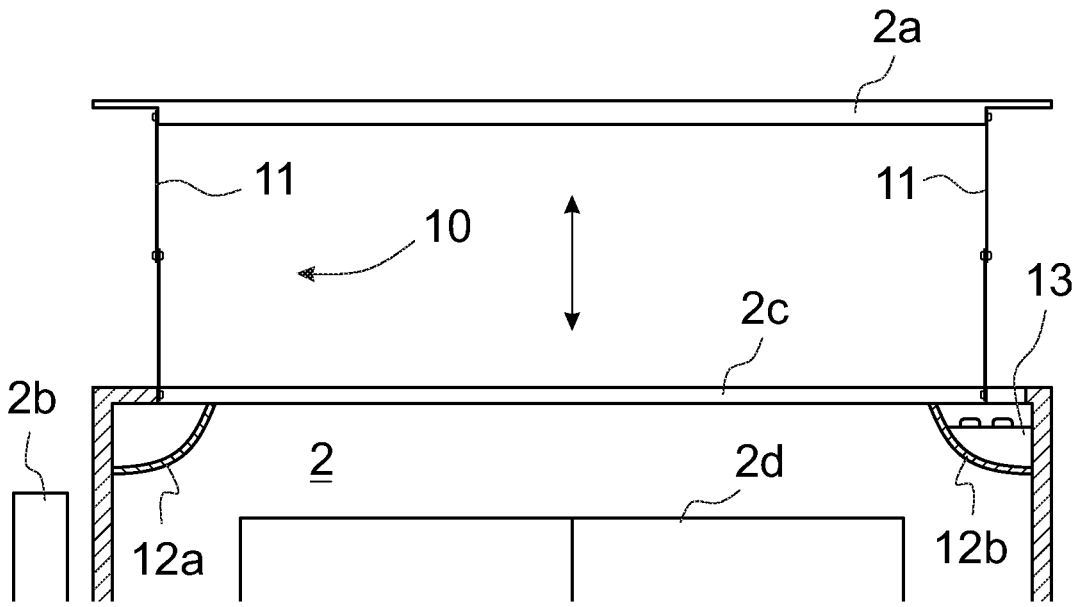
Figure 6:
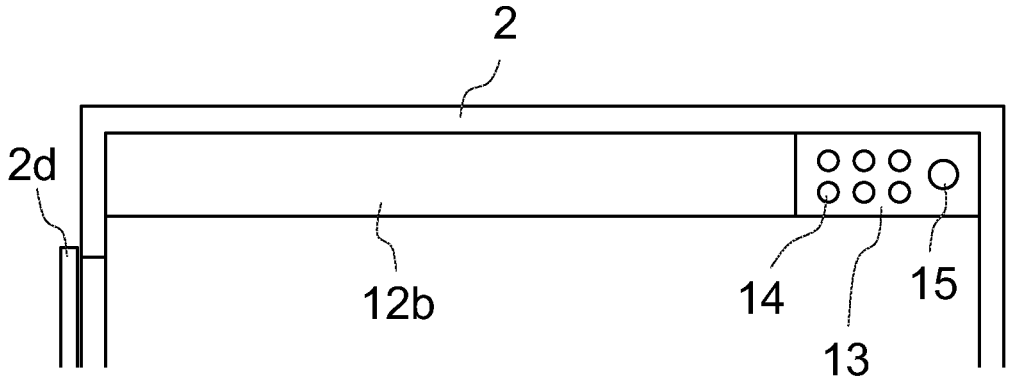

In the following, the invention will be described in detail by the aid of example embodiments by referring to the attached simplified and diagrammatic drawings, wherein FIG. 1 presents in a simplified and diagrammatic back view a part of the building where the back wall of the elevator shaft is removed, and an elevator in the elevator shaft, in which elevator the solution according to the invention can be used, FIG. 2 presents in a simplified and diagrammatic back view the upper part of the elevator shaft in the building according to FIG. 1, FIG. 3 presents in a simplified and diagrammatic back view the upper part of the elevator shaft in the building according to FIG. 1 in the situation where the maintenance or repair task is in progress, FIG. 4 presents in a simplified and diagrammatic front view an elevator car with the door open and a maintenance person starting to open the roof of the elevator car, FIG. 5 presents in a simplified and diagrammatic back view an upper part of the elevator car according to the invention when the roof is lifted upwards for maintenance work, and FIG. 6 presents in a simplified and diagrammatic top view one side of the elevator car according to FIG. 5 when the roof is lifted upwards.

An aspect of the invention is to achieve in every respect a safe elevator arrangement with an elevator car having an openable roof which makes it possible to safely access maintenance and repair targets in an elevator shaft from inside the elevator car, and which also removes the need to step onto the roof of the elevator car, and in addition which also reduces the height of the shaft needed, and in which elevator arrangement the roof of the elevator car can be opened for maintenance purposes safely, fast and easily being inside the elevator car.

FIG. 1 presents in a simplified and diagrammatic back view a part of the building 1 where the back wall of the elevator shaft 1*c* is removed, and an elevator in the elevator shaft 1*c*, in which elevator the solution according to the invention can be used. The building 1 has a roof 1*a* just above the elevator shaft 1*c* and four floors 1*b* served by the elevator.

The elevator comprises among other things an elevator car 2 with an openable roof 2*a*, which elevator car 2 is arranged to run up and down in the elevator shaft 1*c* along guide rails 3, and a counterweight or balance weight 2*b* that is also arranged to run up and down in the elevator shaft 1*c* along its guide rails which are not presented in FIG. 1 for the sake of clarity. Later in this connection only balance weight 2*b* is mentioned when either counterweight or balance weight is meant.

Advantageously the supporting and moving of the elevator car 2 are separated from each other. This makes it possible to achieve an elevator structure where the height of the headroom above the elevator car 2 can be is low as possible. The elevator car 2 is driven by a hoisting machinery 8 equipped with a drive wheel 7. Advantageously the hoisting machinery 8 is located at the bottom part of the elevator shaft 1*c*, below the elevator car 2 and advantageously below the first floor level 1*b*.

A traction member 6 is connected between the balance weight 2*b* and the elevator car 2. The traction member 6 can be a single member or a bunch of similar parallel members, for instance, the traction member 6 can be a toothed belt, chain or other type of member that does not slip on the drive wheel 7. In this embodiment the suspension ratio of the traction member 6 is 2:1. In that case the first end of the traction member 6 is secured at its first fastening point 9, for example at the bottom part of the elevator shaft 1*c*. From the first fastening point 9 the traction member 6 is led upwards to go over and around a traction sheave 2*e* in connection with the balance weight 2*b* and from the traction sheave 2*e* the traction member 6 is led downwards to go under and around a diverting pulley 6*b* and the drive wheel 7 of the hoisting machinery 8 at the bottom part of the elevator shaft 1*c*, from where the traction member 6 continues upwards to go over and around diverting pulleys 6*c* at the bottom of the elevator car 2 and from the diverting pulleys 6*c* again downwards to its second fastening point 9*a* where the second end of the traction member 6 is secured, for example at the bottom part of the elevator shaft 1*c*.

The elevator car 2 is suspended by suspension element 4 that is connected between the balance weight 2*b* and the elevator car 2. The suspension element 4 can be a single member or a bunch of similar parallel members, for instance suspension ropes. In this embodiment the suspension ratio of the suspension element 4 is 2:1. In that case the first ends of the suspension element 4 are secured at their first fastening point 4*c*, for example at the top part of the guide rail 3, from which the suspension element 4 is led downwards to go under and around a diverting pulley 2*d* in connection with the balance weight 2*b*. From the diverting pulley 2*d* the suspension element 4 is led upwards to go over and around a diverting pulley 4*a* that is fitted with bearings on its shaft, for instance at the upper part of the guide rail 3. From the diverting pulley 4*a* the suspension element 4 descends downwards to go under and around diverting pulleys 5 at the bottom of the elevator car 2 and from the diverting pulleys 5 the suspension element 4 is led upwards to its second fastening point 4*b* where the second end of the suspension element 4 is secured, for example at the top part of the guide rail 3. The elevator car 2 is also equipped with safety gear system that is arranged to stop the movement of the elevator car 2 and to lock the elevator car 2 into the guide rails 2 when needed. Thanks to the suspension like this the roof 2*a* of the elevator car 2 can be openable.

Each floor has a landing door 1*e* that is presented in FIG. 1 seen from the direction of the elevator shaft 1*c*. In addition the elevator comprises at least an operating system, an elevator control system, an electrical system, a variety of sensor arrangements and a safety system comprising a maintenance mode, which maintenance mode is here a common term for the operation mode which is activated when performing inspection, test, maintenance or repair work or other operations that require a safe working environment.

FIG. 2 presents in a simplified and diagrammatic back view the upper part of the elevator shaft 1*c* in the building 1 according to FIG. 1. Also in this figure the back wall of the elevator shaft 1*c* is removed and the elevator shaft 1*c* is seen from its backside. In the situation of FIG. 2 the elevator car 2 is in its uppermost floor 1*b* in the top part of the elevator shaft 1*c*. The top clearance between the roof 2*a* of the elevator car 2 and the ceiling 1*d* of the elevator shaft 1*c* is at its minimum.

FIG. 3 presents in a simplified and diagrammatic back view the upper part of the elevator shaft 1*c* in the building 1 according to FIG. 1 in the situation where the maintenance or repair task is in progress. The openable roof 2*a* of the elevator car 2 is opened by lifting it upwards in this embodiment, and a maintenance hole or opening is created between the uplifted roof 2*a* and the upper edges of the elevator car 2. The elevator car 2 has been run with a service run or inspection run in an appropriate location in the elevator shaft 1*c* so that the working person being inside the elevator car 2 has an easy access to the elevator components and appliances in the elevator shaft. In this case the required safety space is created at least partly inside the elevator car 2. The uplifted roof 2*a* protects the working person also from falling tools and other objects that may fall down into the elevator shaft 1*c* from other working sites above, for instance from a top part of a neighboring elevator shaft where another elevator is installed at the same time.

FIG. 4 presents in a simplified and diagrammatic view the elevator car 2 with the doors open and a maintenance person starting to open the roof 2*a* of the elevator car 2. The elevator arrangement according to the invention comprises opening means to open and close the roof 2*a* of the elevator car 2 when the elevator is set to the maintenance mode, with the help of maintenance access panel (MAP) that is usually, for instance, in the control center of the elevator. Maintenance access panel (MAP) can be also called as emergency and test panel. The opening means are activated with the help of the car operating panel (COP) 2*e* inside the elevator car 2 to open and close the roof 2*a* of the elevator car 2 when the elevator is set to the maintenance mode.

The operations of the buttons of the car operating panel 2*e* have been arranged so that they activate different functions in a normal operating mode of the elevator and in the maintenance mode of the elevator. For instance, the Door Open button may open the roof 2*a* of the elevator car 2 in the maintenance mode, and correspondingly the Door Close button may close the roof 2*a* when pressed in the maintenance mode. Also other buttons can be used and also many kinds of the combinations of the buttons can be used. In that case, for example, two buttons are pressed simultaneously or a button can be pressed twice in a short time or the button can be hold pressed for a certain time.

FIG. 5 presents in a simplified and diagrammatic view, an upper part of the elevator car 2 according to the invention. In the embodiment of FIG. 5 the roof 2*a* is open for a maintenance or repair work and a created manhole or opening 2*c* on top of the elevator car 2 makes it possible to reach to the elevator appliances or components in the elevator shaft 1*c* from inside the elevator car 2. In FIG. 5 the back walls of the elevator shaft 1*c* and the elevator car 2 are removed and the elevator shaft 1*c* and elevator car 2 are seen from their backside. In the situation of FIG. 5 the door 2*d* of the elevator car 2 is closed.

In the embodiment of FIG. 5 the roof 2*a* is openable by lifting it straight upwards. For that purpose the elevator comprises opening means 10 that are arranged to open and close the roof 2*a* when the elevator is switched on to the safe maintenance mode. The moving of the roof 2*a* can be carried out in several ways. One way is to use articulated arms and one or more actuators, for example gas springs to turn the articulated arms 11. In this embodiment four articulated arms 11 are used, two pieces on each side of the elevator car 2. The actuators are not presented in the FIG. 5. The actuators are controlled by the elevator control system according to the commands given by the buttons of the car operating panel 2*e* in the elevator car 2. The elevator arrangement comprises means, which are connected with the elevator control system and the maintenance action panel (MAP) to allow the use of the buttons of the car operating panel 2*e* to open and close the roof 2*a* of the elevator car 2.

FIG. 5 also presents corner casings 12*a*, 12*b* that are fastened at opposite upper corners inside the elevator car 2, preferably onto the side walls of the elevator car 2 but possibly also to the under surface of the roof 2*a*. The corner casings 12*a*, 12*b* may comprise car lighting and other electrical appliances, including all printed circuit boards needed by an elevator car, a reserve battery with its charger, and also apertures for elevator car ventilation.

FIG. 6 presents in a simplified and diagrammatic top view one side of the elevator car 2 according to FIG. 5 when the roof 2*a* is lifted upwards. The roof 2*a* is not shown in FIG. 6. In the embodiments of FIGS. 5 and 6 the second corner casing 12*b* comprises among other things a maintenance control unit 13 with operating buttons 14, such as maintenance mode buttons, and an emergency stop button 15.

The elevator arrangement according to the invention can be advantageously used in maintenance work for example by using the following phases:

- in the beginning the elevator car 2 is called to the lowermost floor 1*b* for example by a floor landing call button,
- the switch to enable test operations is activated in the maintenance action panel (MAP),
- the elevator car 2 arrives at the lowermost floor 1*b* or the floor 1*b* where the maintenance person is, and the elevator doors 1*e*, 2*d* are opened,
- the maintenance person presses the call button in the car operating panel 2*e* and the elevator car 2 runs to the wanted floor 1*b* and stops at the floor 1*b* keeps the doors 1*e*, 2*d* closed,
- the maintenance person gives a short push to the Door Open button to open the doors 1*e*, 2*d* of the elevator car 2. After that the doors 1*e*, 2*d* are closed,
- for opening the roof 1*a* of the elevator car 2 the maintenance person presses steadily the Door Open button for at least some seconds. When the maintenance mode is activated the roof 2*a* of the elevator car 2 now opens. However, if the elevator car 2 is in its uppermost floor the roof 2*a* does not open.
- the roof 2*a* of the elevator car 2 is closed by pressing steadily the Door Close button for at least some seconds.

When the roof 2*a* of the elevator car 2 is closed the maintenance person can run with the elevator car 2 from one floor 1*b* to another floor 1*b* by using car operating panel 2*e* in a normal way, though the elevator is not in the normal mode. After arriving to a new floor 1*b* the maintenance person can again open the roof 2*a* of the elevator car 2 and perform the tasks needed.

If the car operating panel 2*e* of the elevator car 2 comprises neither Door Open button nor Door Close button the uppermost floor button can be used to open the roof 2*a* and the lowermost floor button can be used to close the roof 2*a*.

The predefined buttons of the operating panel 2*e* of the elevator car 2, either the Door Open and Door Close buttons or the uppermost floor button and lowermost floor button, or some other appropriate buttons have two operation modes depending on the way to press the predefined buttons. When the pressing time is short the operation is a normal operation in the normal operation mode, and when pressing time is steady and at least some seconds the buttons either open or close the roof 2*a* of the elevator car 2. Thus, depending on the pressing time the same button of the operating panel 2*e* of the elevator car 2 can, for example, open the doors 1*e*, 2*d* of the elevator car 2 or open the roof 2*a* of the elevator car 2.

It is obvious to the person skilled in the art that the invention is not restricted to the examples described above but that it may be varied within the scope of the claims presented below. Thus, for instance the roof of the elevator car and the mechanisms for opening and closing the roof can be different from what is presented above. For instance, the roof can be opened around a hinge to one side of the elevator car or from the middle to two sides of the of the elevator car or the roof can be a flexible element comprising narrow slats, which are connected to each other in a way that they can make a part of the roof bend downwards at the upper corner of the elevator car when the roof is opening and sliding away from the top of the manhole or the opening of the elevator car.

It is also obvious to the person skilled in the art that the suspension and/or traction ratio of the elevator car can be different from what is presented above. The suspension and/or traction ratio can be, for instance 1:1, the suspension ratio can also be 2:1 but the traction ratio 1:1. However, it is essential that the elevator structure is such that the roof of the elevator car can be easily opened.

It is further obvious to the person skilled in the art that the suspension and traction arrangement of the elevator car can be different from what is presented above. The location of the hoisting machinery can also be in the upper part of the elevator shaft, and the suspension and traction of the elevator car can be carried out in different ways, for instance with common hoisting ropes that suspend the elevator car and the balance weight and also moves them.

The invention claimed is:

1. An elevator car configured to move in an elevator shaft along guide rails, the elevator car comprising:

a roof configured to transition between a closed position and an open position by moving with respect to an upper part of the elevator car;

an actuator configured to at least transition the roof to the open position by moving the roof in a direction that does not penetrate an inside of the elevator car to provide access to elevator components in the elevator shaft during a maintenance mode from inside the elevator car; and a car operating panel operatively connected to the actuator to control access to the elevator components in the elevator shaft by moving the roof.

2. The elevator car according to claim 1, wherein the actuator is further configured to transition the roof to the closed position by moving the roof to prevent access to the elevator components in the elevator shaft from inside the elevator car.

3. The elevator car according to claim 1, wherein the car operating panel comprises:

a plurality of buttons, at least one of the plurality of buttons having at least two different functions depending on an operating mode, at least one of the at least two different functions being associated with the roof.

4. The elevator car according to claim 3, wherein the at least one of the plurality of buttons of the car operating panel are configured to switch between the at least two different functions based on whether the operating mode is a normal operating mode or the maintenance mode.

5. The elevator car according to claim 4, wherein the at least one of the plurality of buttons of the car operating panel are configured to switch between controlling a first function in the normal operating mode and a second function to control the actuator to open and close the roof of the elevator car in the maintenance mode.

6. The elevator car according to claim 5, wherein the at least one of the plurality of buttons of the car operating panel are configured to control the first function when pressed for a first time period and to control the second function when pressed for a second time period longer than the first time period.

7. The elevator car according to claim 3, wherein the at least one of the plurality of buttons of the car operating panel include a door opening button and a door closing button, the door opening button configured to control the actuator to open the roof of the elevator car when pressed in the maintenance mode, and the door closing button configured to control the actuator to close the roof of the elevator car when pressed in the maintenance mode.

8. The elevator car according to claim 3, wherein the at least one of the plurality of buttons of the car operating panel include an uppermost floor button and a lowermost floor button, the uppermost floor button configured to control the actuator to open the roof of the elevator car when pressed in the maintenance mode, and the lowermost floor button configured to control the actuator to close the roof of the elevator car when pressed in the maintenance mode.

9. The elevator car according to claim 1 further comprising:

a movable roof support configured to support the roof.

10. The elevator car according to claim 9, wherein the actuator comprises:

a motor configured to control the movable roof support.

11. The elevator car according to claim 9, wherein the movable roof support comprises:

a first pair of arms attached between a ceiling of the elevator car and a first end of the roof; and a second pair of arms attached between the ceiling and a second end of the roof.

12. The elevator car according to claim 9, wherein the actuator is configured to control the movable roof support to move the roof from the closed position to the open position in response to an instruction from the car operating panel inside the elevator car during the maintenance mode via a same button utilized to control movement of the elevator car during a normal operating mode.

13. The elevator car according to claim 12, wherein the actuator is configured such that the movable roof support does not move the roof from the closed position to the open position in response to receipt of the instruction from the car operating panel during the maintenance mode while the elevator car is situated at an uppermost floor.

14. The elevator car according to claim 1, wherein an elevator control system is configured to restrict the roof from transitioning from the closed position to the open position during the maintenance mode while the elevator car is situated at an uppermost floor.

15. The elevator car according to claim 1, wherein the car operating panel is configured to control the actuator to move the roof only after the elevator car has been set to the maintenance mode via an maintenance access panel (MAP) accessible from outside of the elevator car.

16. A movable roof of an elevator car configured to move in an elevator shaft along guide rails, the movable roof comprising:

a ceiling including a movable panel therein;

a movable roof support attached to the movable panel, the movable roof support configured to move between a closed position in which the movable panel is aligned with the ceiling to restrict access to the elevator shaft and an open position in which the movable panel moves with respect to the ceiling in a direction that does not penetrate an inside of the elevator car to allow access to the elevator shaft; and an actuator configured to control the movable roof support to move from the closed position to the open position in response to an instruction from a car operating panel inside the elevator car during a maintenance mode via a same button utilized to control movement of the elevator car during a normal operating mode.

* * * * *